US007407356B2

(12) United States Patent
Spiel

(10) Patent No.: US 7,407,356 B2
(45) Date of Patent: Aug. 5, 2008

(54) SEMI-AUTOMATIC PLASTIC SPIRAL BINDING MACHINE

(75) Inventor: Norton Spiel, Jamaica, NY (US)

(73) Assignee: Spiel Associates, Inc., Long Island City, NY (US)

( * ) Notice: Subject to any disclaimer, the term of this patent is extended or adjusted under 35 U.S.C. 154(b) by 0 days.

(21) Appl. No.: 11/517,857

(22) Filed: Sep. 8, 2006

(65) Prior Publication Data

US 2008/0095596 A1 Apr. 24, 2008

(51) Int. Cl.
*B42B 5/00* (2006.01)

(52) U.S. Cl. ..... 412/33

(58) Field of Classification Search ..... 412/9, 412/33, 34, 38–40
See application file for complete search history.

(56) References Cited

U.S. PATENT DOCUMENTS 5,569,012 A * 10/1996 Kosasa et al. ..... 412/33
5,785,479 A * 7/1998 Battisti et al. ..... 412/39
6,036,423 A * 3/2000 Westra et al. ..... 412/38

* cited by examiner

*Primary Examiner*—Derris H Banks
*Assistant Examiner*—Kyle Grabowski
(74) *Attorney, Agent, or Firm*—Alfred M. Walker

(57) ABSTRACT

A book binding machine has a page-forming mode and a spiral-binding mode, where a curved inexpensive piece of binding spiral coil or a convex member form a collection of pages being bound into a concavity on the spine of the pages to be bound with a proper pitch angle to accept insertion of a plastic spiral binding coil. An optional pivoting page-forming carriage and an optional pivoting cutter/crimper are respectively movable between engaged and disengaged positions. The book forming bar is optionally moved out of the way in an intermediate position while the spiral is spun into the perforations. Then the brackets place the cutter bar in position. Pulsed air is preferably used to operate the vibrator and the exhaust pulsed air is fed to a page aerating manifold to keep pages from clinging to each other prior to the sheets being clamped before insertion of the plastic spiral coil.

2 Claims, 9 Drawing Sheets

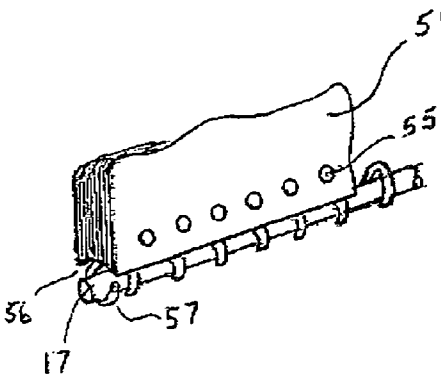
Fig. 4A
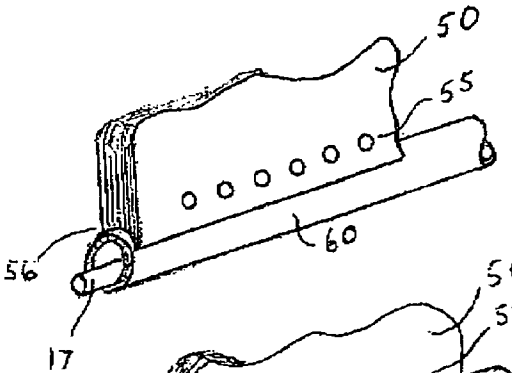
Fig. 4B (PRIOR ART)
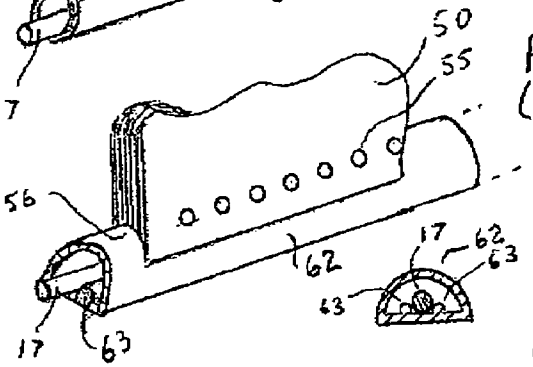
Fig. 4C (PRIOR ART)
Fig. 4D (PRIOR ART)
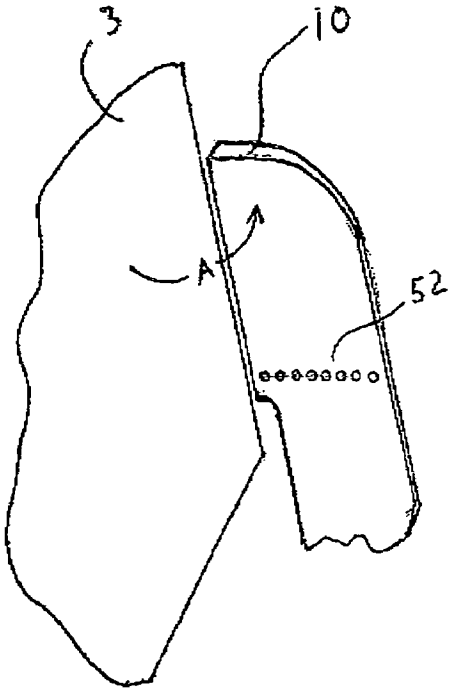
FIG. 3

END TO BE CUT OFF AND DISCARDED
IN BOOK
BEND-IN END
68
90
91
92
93
97
99

SEMI-AUTOMATIC PLASTIC SPIRAL BINDING MACHINE

FIELD OF THE INVENTION

The present invention relates to book binding with a compact machine having a page-forming mode and a spiral-insertion and cutting with bending mode, where a curved foundation forms a collection of pages being bound into a concave edge, and an angled side guide sets a proper pitch angle to accept insertion of a plastic spiral binding coil.

BACKGROUND OF THE INVENTION

Existing book binding coil insertion machines insert plastic spiral coil into a collection of pages being bound. Previously, such book binding machines have been large, and have several sequential functions to accomplish forming up pages, inserting plastic coils and cutting and crimping the coils. While forming up the pages, the proper tool must be selected from a set so as to match the variety of book thickness being bound. Most often, the exact tool for the particular thickness is unavailable to form the sheets properly.

Each plastic spiral gets inserted through the holes in a stack of sheets forming a book.

OBJECTS OF THE INVENTION

It is therefore an object of the present invention to provide a book binding machine having a page-forming mode and a spiral-binding mode, where a curved foundation forms a collection of pages being bound into a concave edge.

It is also an object of the present invention to provide a book binding machine utilizing a page-forming convex support member attached to a carriage bar movable between an engaged position and a disengaged position and means to produce said motion therebetween.

It is also an object of the present invention to use the pulsating pneumatic exhaust of a pneumatic vibrator, instead of discarding the exhaust air, so as to aerate the binding edges of the plurality of book pages during a book binding function.

It is also an object of the present invention to provide a book binding machine that is relatively small and compact.

Other objects which become apparent from the following description of the present invention.

SUMMARY OF THE INVENTION

This invention describes a semi-automatic plastic spiral binding machine with several improvements over prior machines in the areas of page alignment.

A major subassembly of this compact binding machine is a carriage formed of two circular arc brackets near opposite sides of the machine supporting three transverse bars. The three bars have specific functions. One is the book forming carriage bar, a second is a vibrator support bar, and a third is a cutter bar. Since the circular arc brackets are rotatable, they are used to position the various bars in relation to the book forming/binding station which is another subassembly of this binding machine.

At the start of the binding process, the circular arc brackets are rotated so that the book forming carriage bar is properly positioned under the page forming/binding station to support pages introduced into the open page holder, such as, for example, a page holding clamp. After the book pages are formed and clamped, the book forming carriage bar is rotated out of the way of the advancing plastic spiral which binds the pages into a book; this is an intermediate position with no transverse bar engaged with the binding process. Then, in a third distinct rotation, the cutter bar is rotated into position engaging coils of the spiral at either end of the bound book with cutter/crimpers which then proceed to cut and bend the ends of the plastic spiral thereby completing the binding process. The vibrator bar does not have a unique operational position. It introduces vibration via the circular brackets to the book forming carriage bar during the book forming process to aid gravity and combat page clinging so that the book pages assume a configuration suitable for binding prior to the engagement of the page holding clamp.

For accurate tracking of the plastic spiral through the holes in a stack of sheets forming a book, two orthogonal edges of the book should be pre-formed so as to create a spiral path through the binding holes. Specifically, since the spiral coil is inserted adjacent the binding edge of the book, this edge should be formed into a concave shape of a diameter closely approximating the diameter of the plastic spiral coil. At the same instant prior to entry of the spiral coil, the perforation holes should be angled laterally at the pitch angle of the spiral coil. This step is known as sheet or page forming.

The present invention provides a more simple device for shaping the gathered pages waiting to be bound into a concave shape to accept the spiral coil segments therethrough. This shaping device is a convex rest upon which the gathered page edges are placed. The convex shape of the rest produces a corresponding concave shape to the stack of pages, which is needed to provide the desired curvature of the multiple page perforations.

The convex rest upon which the gathered page edges are placed produces the required corresponding concave shape of the binding edge of the book being formed.

The ideal convex rest for forming the shape of proper diameter for the book being bound is a section of plastic binding spiral used to bind this particular book. This length of binding spiral is clamped to the book forming carriage bar before the start of the run. In this way there is no confusion in selecting the proper rest and no tooling is required for each book thickness needed to be bound.

This surface can be formed by a piece of rigid tubing of the appropriate diameter, or by an extruded profile having a semicircular outer top surface. In the preferred embodiment, a length of the actual binding plastic spiral is introduced into the binding machine and clamped in place to form the required concave shape of the binding edge of the book. In this way, there is no confusion about the proper diameter of tubing or semicircular profile for a particular run. The operator simply uses a sample of the actual binding spiral with a convex edge prior to starting the run.

The convex edge can be provided from a corresponding second plastic spiral coil of the same size and shape as the spiral coil to be inserted into the pages, or by a rigid member having a convex portion, such as a cylinder, semi-cylinder or other member having at least an arcuate convex surface portion.

Both the second plastic spiral coil and the convex rigid member are not narrow enough in their respective total lengths to fit between respective loops of the first plastic spiral coil supporting the concave edge of the pages being bound into a book.

An angled side guide as taught in the 1997 Spiel COIL MASTER® Binding machine of Spiel Associates, Inc. is used to shift the pages of the book laterally at the proper pitch angle. The angled stop bracket is used to form the proper pitch, matching that of the binding spiral, in the stack of pages being formed into a book. The combination of concave shaped binding edge with the proper page pitch angle allows the plastic binding spiral to hit each perforation of each page perfectly and smoothly as it is rotated during insertion.

The compact semi-automatic plastic spiral binding machine also includes a spreader mechanism, taught by U.S. Pat. No. 6,851,907 of Spiel using spreaders to spread apart the leading edge of a plastic spiral being inserted into pages to form a book to compensate for first and last holes of the pages having margin differences from front and rear ends of the book, greater than a predetermined spacing of all intermediate holes.

To help prevent pages from clinging to each other and to help them rest on the convex rest during book forming, a vibrator vibrates the page forming carriage by transmitting vibration via the curved side brackets. A pneumatic vibrator of the circulating ball variety is used. This operates on a normal compressed air or "shop air" supply, only during the book forming process.

An artifact of this type of vibrator is that its exhaust is a pulsating stream of compressed air. In this invention, an aerator is directed to aerate the pages. In one example, this supply of air is the exhaust of the vibrator is directed to a manifold on the back of the angled bracket stop and allowed to exhaust through a linear array of small holes transverse to the pages of the book resting against it. This supply of pulsed air being blown between the pages is used to aerate the pages being bound, so as to further minimize cling during the book forming process prior to being clamped in the proper shape and position for binding.

At this point in the process, the circular brackets are rotated to space the page forming carriage bar away from the bottom edge of the clamped book into an intermediate position to provide clearance and prevent interfering with the plastic spiral which is then rotated into the holes adjacent the bottom edge of the clamped book. The leading edge of the spiral exiting the last binding hole is sensed triggering the end of the spiral advance phase.

The next process step positions the cutter bar under the bound edge of the bound book so that each of the pair of cutter/crimpers is brought into contact with the binding spiral at either end of the book. These are used to cut and bend the spiral to finish the binding process at which time the book clamp is released.

Prior to the start of the binding run, the pair of cutter/crimpers are positioned at the proper locations on the cutter bar insuring that the plastic spiral is cut and bent at the proper locations matching the size and position of the books being bound.

BRIEF DESCRIPTION OF THE DRAWINGS

The present invention can best be understood in connection with the accompanying drawings. It is noted that the invention is not limited to the precise embodiments shown in drawings, in which:

FIG. 3 is a perspective detail of an angled side guide showing aeration holes;

FIGS. 4A-4D are four detail drawings showing various book support methods during book, respectively, as follows:

FIG. 4A. is a perspective view of use of binding spiral,

FIG. 4B. is a perspective view of use of a prior art cylindrical rigid tubing, FIG. 4C. is a perspective view of use of a prior art semi-cylindrical profile extrusion, and FIG. 4D. is an end crossectional view of the prior art semi-cylindrical profile extrusion of FIG. 4C;

DETAILED DESCRIPTION OF THE INVENTION

Figure 1:
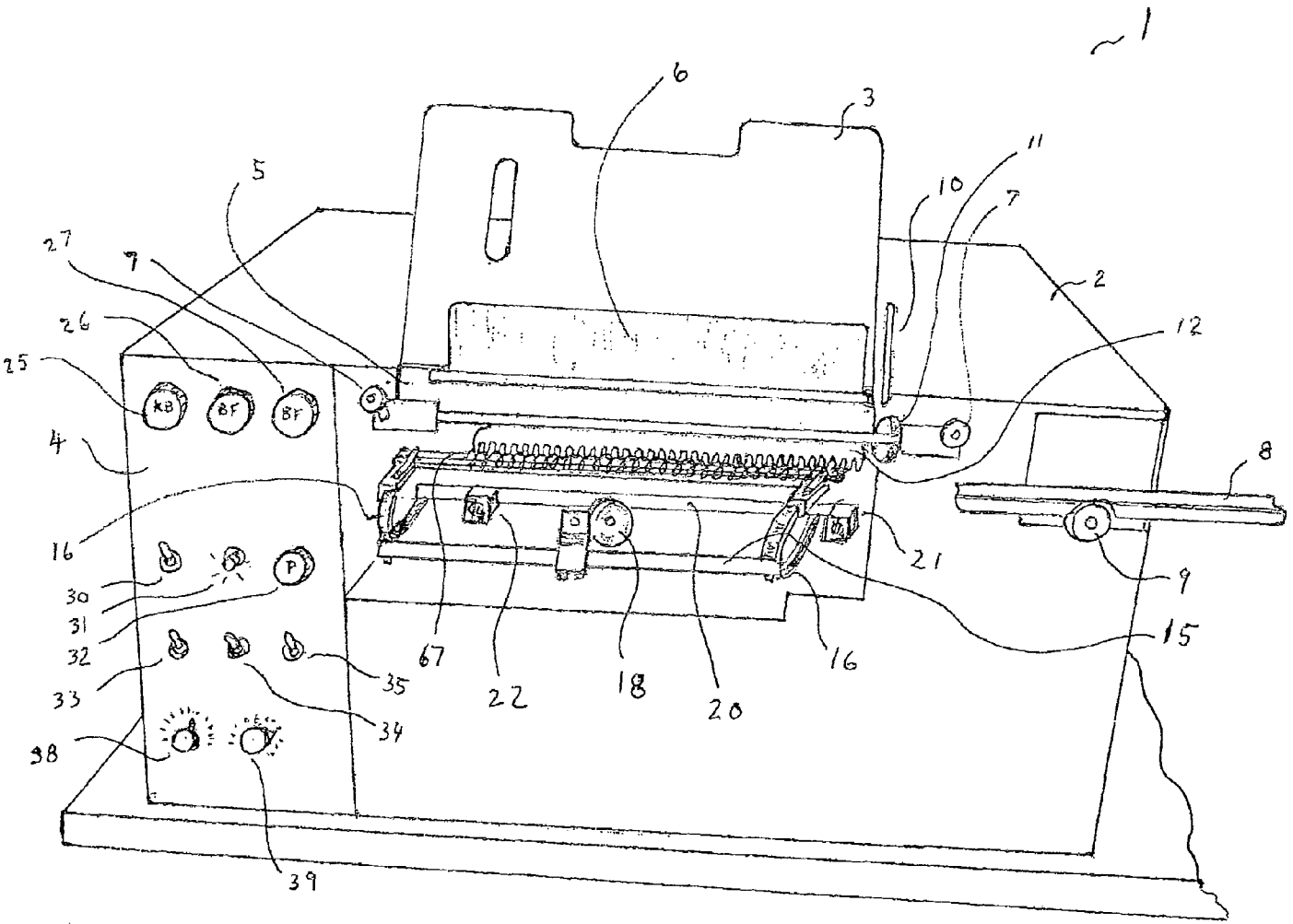
FIG. 1 is a perspective view of the binding machine of this invention shown just prior to book insertion with book forming carriage in place.
Figure 5:
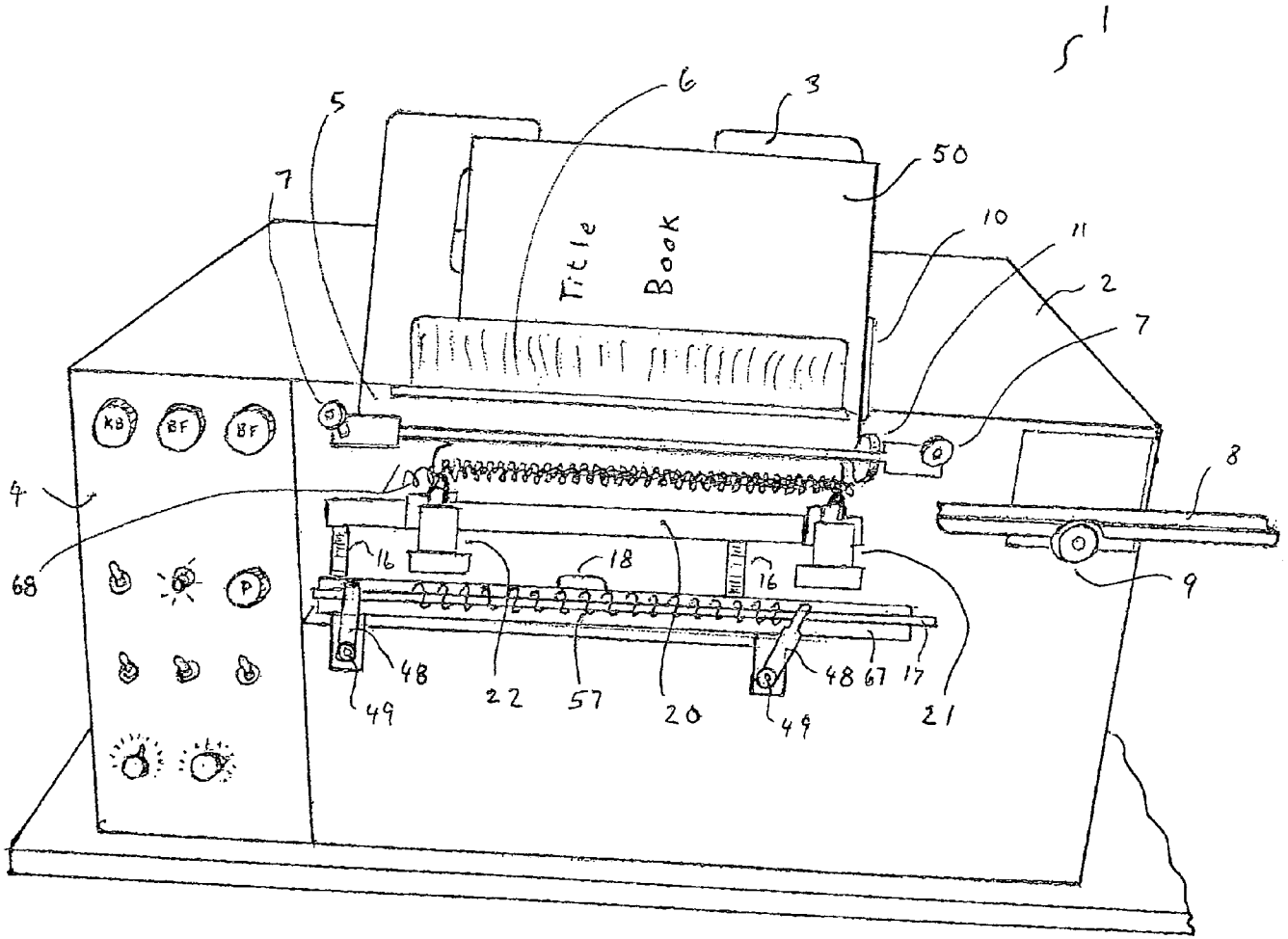
FIG. 5 is a perspective view of the binding machine with cutter/crimpers engaged and book forming carriage spaced apart.

FIG. 1 shows binding machine 1 of this invention prior to the introduction of the book pages. Housing 2 encloses the pneumatic and electrical components of this table-top binding machine. Operating panel 4 houses the operator controls. Circular arc brackets 16 connect book forming carriage bar 67 to vibrator bar 15 (with vibrator 18) to cutter bar 20 (with cutter/crimpers 22 and 21) permitting the book forming carriage bar 67 to be raised into position as shown or alternatively the cutter bar 20 to be placed into position at that phase of the operation, as shown in FIG. 5.

Figure 2:
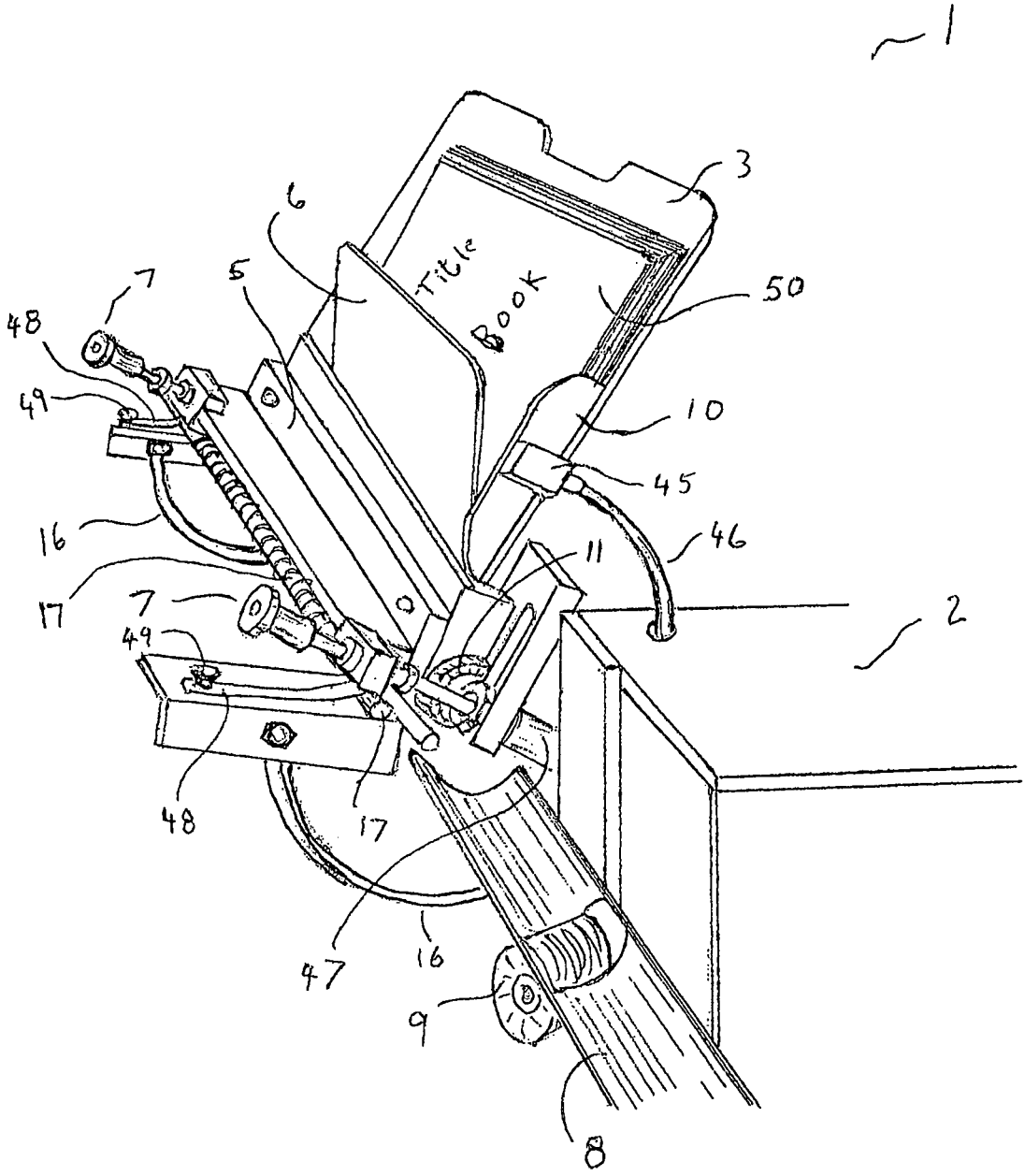
FIG. 2 is a side perspective detail with a book of pages inserted during a book forming step.

As shown in FIGS. 1 and 2, back book support 3 is angled backwards while page guide 6 is angled forward. Angled stop 10 sets the pitch angle to match the binding spiral 68, shown in FIGS. 5 and 6. Comb guide 12 guides a the binding spiral 68 during insertion. A page holder, such as book clamp 5, with gap adjusters 7 holds the book pages together after forming. Spiral conveyor or trough 8 receives the binding spiral 68 which is conveyed into the machine via powered conveyor roller 9. Spinner wheel 11 rotates the plastic spiral 68 into the book binding holes.

FIG. 1 also shows that control panel 4 has three position adjusting knobs at the top, knife (cutter) bar up/down 25, book former up/down 26 and book former in/out 27. On the next row of control panel 4 is main power switch 30, power-on indicator 31, and pause cycle button 32 which stops action momentarily. Next, are three toggle switches for spinner power 33, conveyor power 34, and knife stop 35. On the bottom of panel 4 are two speed controls, spinner speed 38 and conveyor speed 39. A foot pedal or other user activator (not shown) is used to start the automated process once book has been formed.

FIG. 2 is a side perspective view depicted during the book forming process with book 50 inserted. Note air manifold 45 for aeration connected to vibrator 18 of FIG. 1 with exhaust transferred via pneumatic line 46. One of two pneumatic cylinders 47 is shown; they are used to clamp the pages of book 50 after it is formed.

FIG. 3 shows the array of aeration holes 52 in angled side guide 10. Note that stop 10 is positioned at an angle, such as obtuse angle "A" shown or an acute angle, to set book pages at the proper pitch angle.

FIG. 4 shows three different types of round page rests used in forming the concave binding edge of book 50. In the preferred embodiment of FIG. 4A, book 50 rests atop a length of a second sample binding plastic spiral coil 57 which is clamped in position by rod 17. Second sample plastic spiral coil 57 supports the concave edge of the pages being bound into book 50. Edge 56 of book 50, adjacent to binding holes 55, is formed into a concave shape of the proper diameter. In prior art FIG. 4B, a length of a convex page support member, such as a rigid tubing 60 having at least a portion of its outer surface being convex, is used instead. In prior art FIG. 4C, an extruded profile 62 as shown in crossection. Prior art FIG. 4D shows convex surface 62 which is used to form concave shape 56 along the binding edge.

FIG. 5 shows binding machine 1 with cutter/crimpers 22 and 21 in place and book forming carriage bar 67 spaced out of the way for coil insertion. Note clamp leaf springs 48 with knobs 49 used to retain clamping rod 17. Rod 17 is clamping spiral 57 which had been used during the prior book forming phase.

Figure 6:
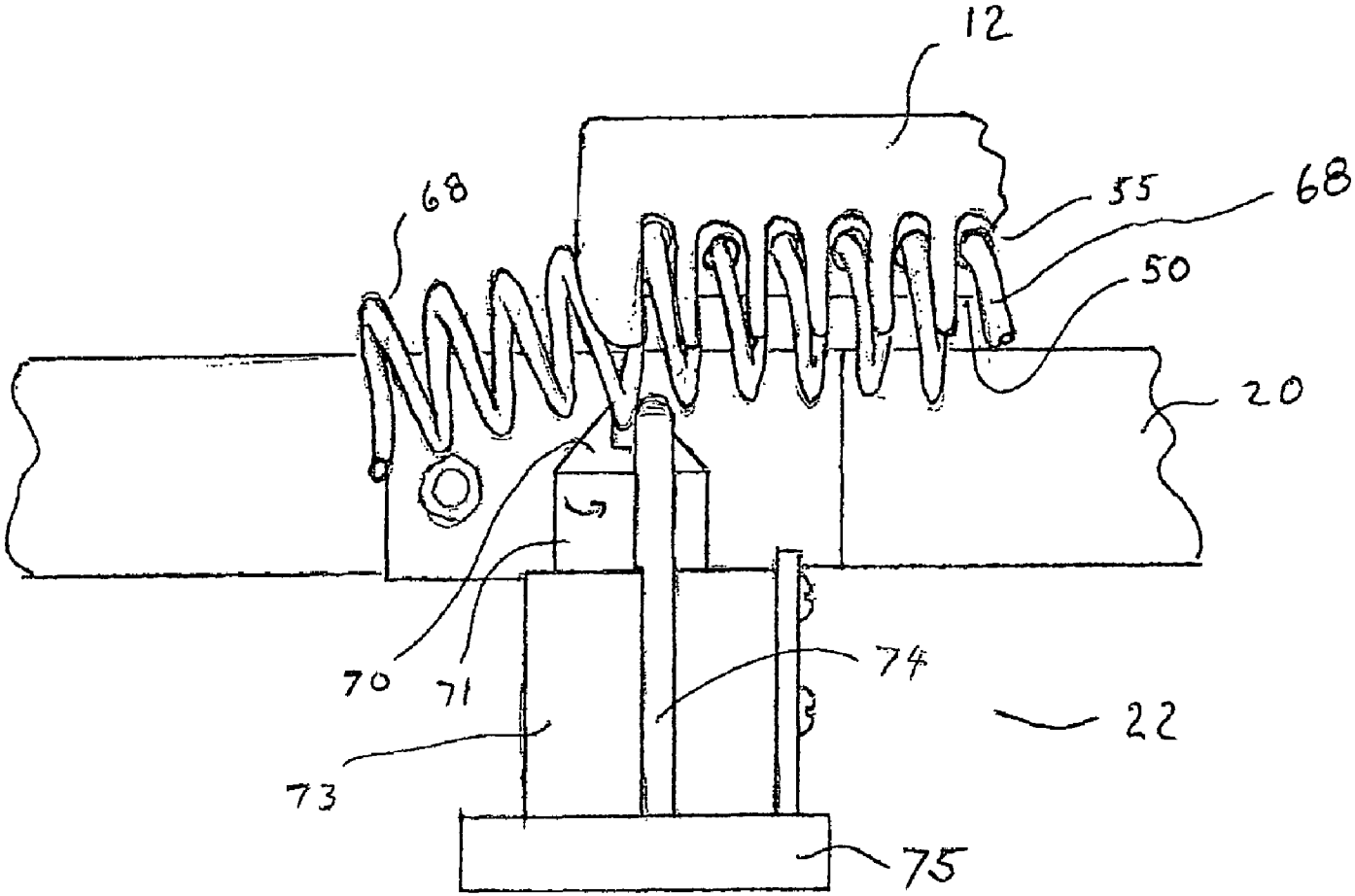
FIG. 6 is a front elevational view close-up detail of cutter/crimper engaging plastic spiral prior to actuation.

FIG. 6 is a side view detail of cutter/crimper 22 engaging binding spiral 68 which has emerged from binding holes 55 in book 50 at the left side. Cutter/crimper 22 has a rotatable round shaft 71 with conical top 70 having a transverse slot engaging spiral 68. Housing 73 also holds stationary knife blade 74. Rotary actuator 75 rotates shaft 71.

Figure 7B:
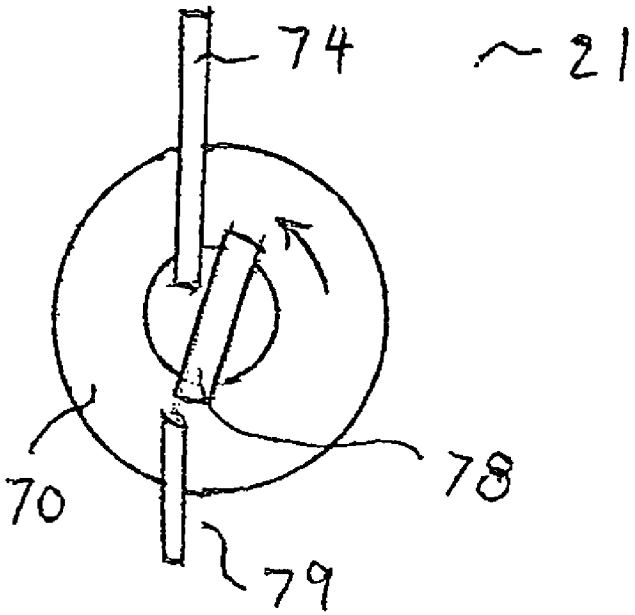
FIGS. 7A and 7B are top plan schematic views of both cutter/crimpers in their resting positions with slots shown at spiral pitch angle.
Figure 7A:
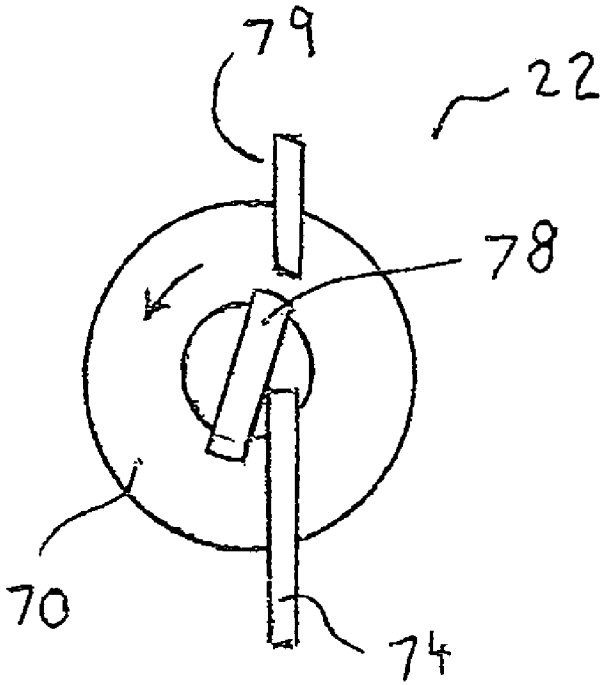

FIG. 7 is a top schematic view of cutter/crimpers 22 at FIGS. 7A and 21 at FIG. 7B. They both turn in the same direction (counterclockwise) to cut and bend in the proper direction. In this view, slots 78 are positioned at the starting pitch angle. Note the opposite placement of stationary knife blades 74 and coil holders 79 in FIGS. 7A and 7B. This insures that the free end of the spiral at each end is bent inward toward the center of the book.

Figure 8:
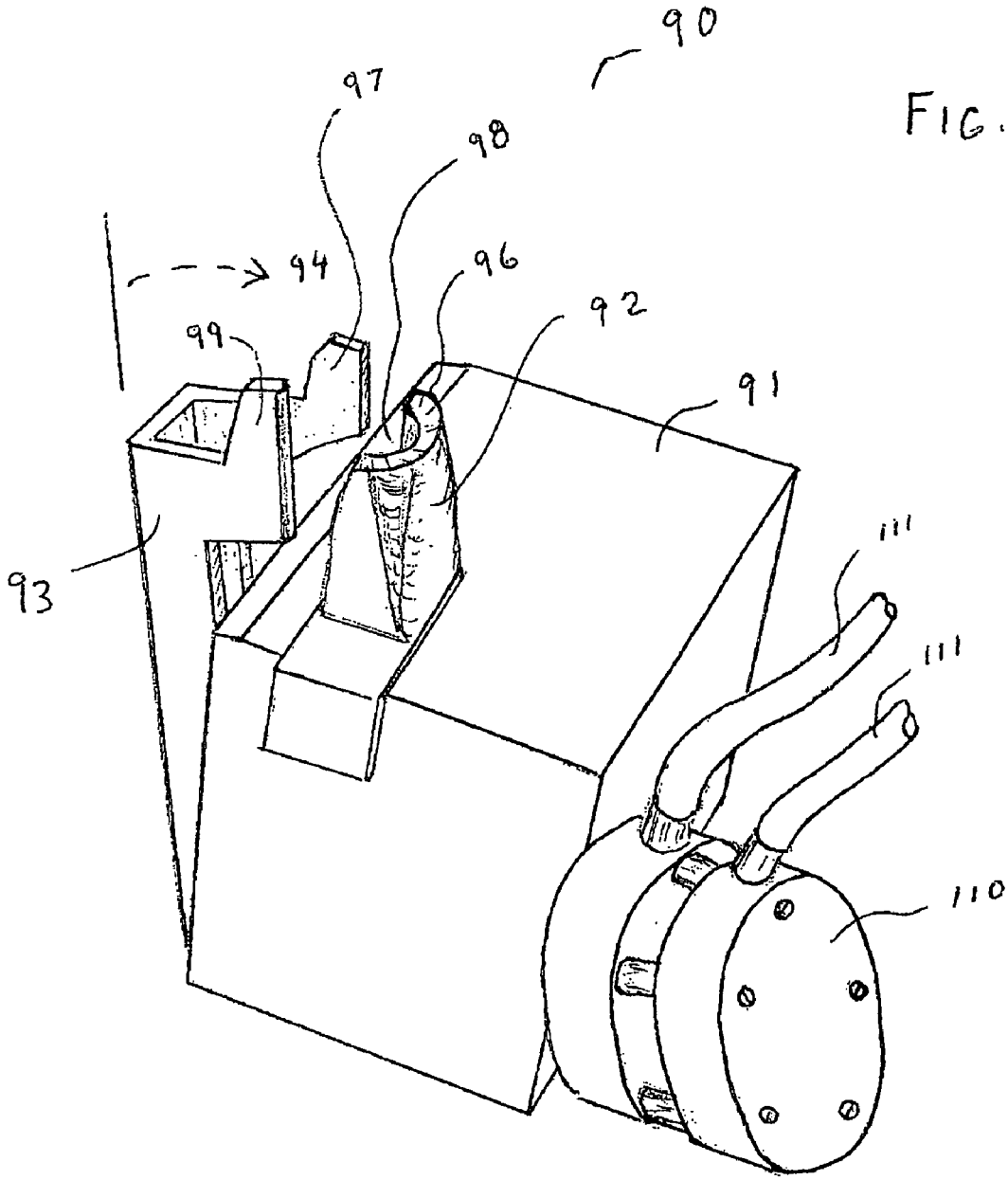
FIG. 8 is a perspective view of an alternate embodiment cutter/crimper using a pneumatically operated pivoting arm and a fixed anvil.
Figure 9:
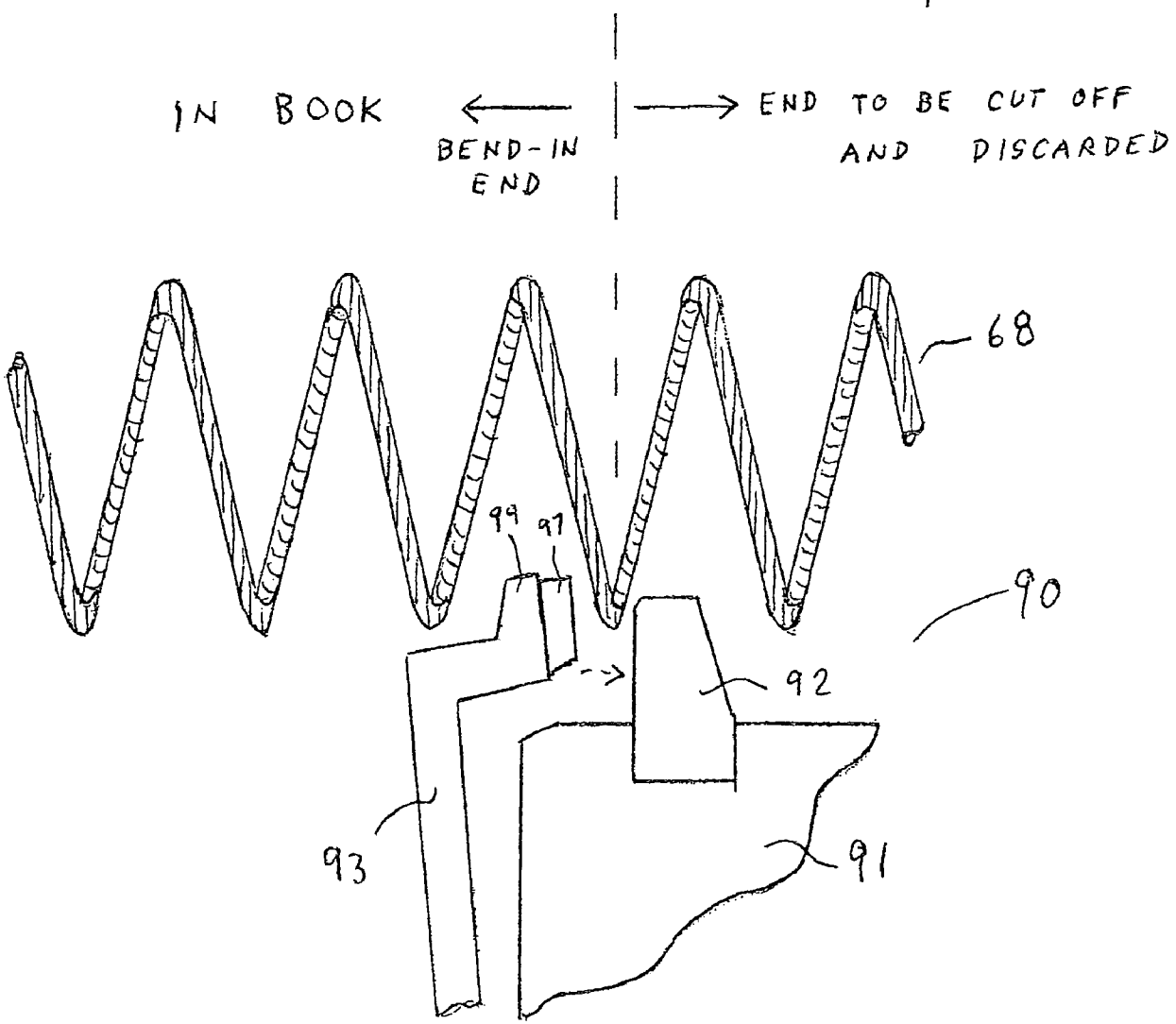
FIG. 9 is a side view detail showing a loop of the binding coil placed between the pivoting arm and the fixed anvil prior to the single-stroke cutting and crimping operation; and, FIG. 10 is a top view detail of a loop of binder coil between the pivoting arm and the fixed anvil prior to the operation of cutting and crimping; also shown is the final configuration of the end of the binding coil after the operation.
Figure 10:
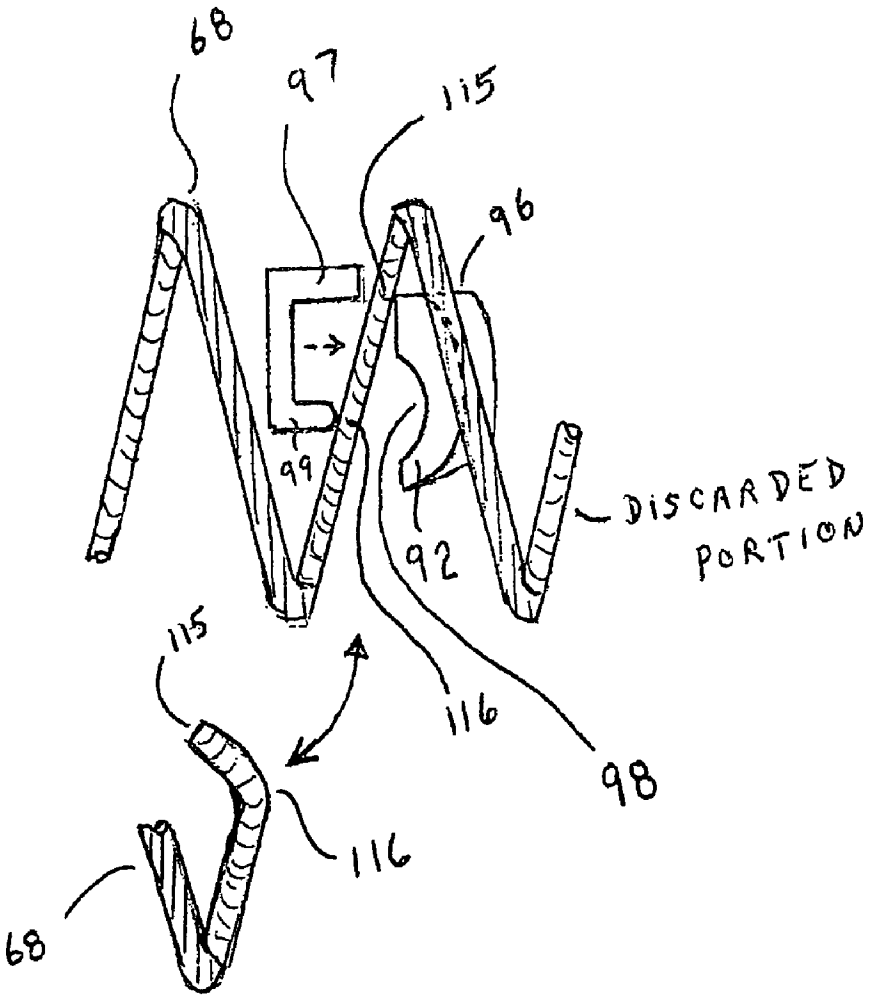

An alternate embodiment of cutter/crimper is shown in FIGS. 8-10. In FIG. 8, cutter/crimper 90 is shown with chassis block 91, pivoting arm 93, cutter 97, crimping bar 99, and anvil 92 which is fixed and attached to block 91. In operation, short-stroke pneumatic actuator 110 operated by flexible compressed air hoses 111, moves arm 93 from the open position shown in direction 94 toward anvil 92 so that in the closed position the inside surface of cutter 97 will be along side distal edge 96 of anvil 92 while the leading edge of crimper bar 99 will be within the concave recess 98.

FIGS. 9 and 10 show side and top detail views respectively of the placement of binding coil 68 within the space between arm 93 and anvil 92 prior to cutting and crimping. Note that the features which engage coil 68 are small, but they can accommodate a wide range of crossectional diameters of plastic coil material. The proper positioning shows that pivoting arm 93 must be placed toward the book portion of coil 68 to provide the proper inward bend of the cut end. Note that the cutting blade 97 is longer in the stroke direction than crimping bar 99. As shown in FIG. 10, cutter 97 will shear coil 68 at point 115 between cutter 97 and anvil edge 96; this is basically scissor type action. A little later in the same stroke period, the edge of crimper 99 will force the coil loop near the just cut end at point 116 into cavity 98 thereby crimping it into the configuration shown below in the same figure.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

I claim:

1. A plastic spiral coil binding machine comprising:

a housing having access to receive a binding edge of book pages to be bound by a first plastic spiral coil, said book pages having a row of spaced perforations along said binding edge to receive said first plastic spiral coil;

a positioning carriage mounted on a front face of said housing, said carriage incorporating a pivoting page forming bar, and a pivoting cutter/crimping bar for cutting and crimping said first plastic spiral coil at both ends of said binding edge after said first plastic spiral coil is threaded through said perforations;

a second length of plastic spiral coil comprising a sample of said first plastic spiral coil clamped in position by a rod inserted therethrough, said sample of said plastic spiral coil forming a rest for the concave binding edge of said book pages, said sample of said plastic spiral coil presenting a required convex shape of proper diameter matching a thickness of said book; and, a page holder for fixing in position said book pages after being positioned by said second length of plastic spiral coil attached to said page forming bar.

2. A plastic spiral coil binding machine comprising:

a housing having access to receive a binding edge of book pages to be bound by a first plastic spiral coil, said book pages having a row of spaced perforations along said binding edge to receive said first plastic spiral coil;

a second length of plastic spiral coil comprising a sample of said first plastic spiral coil clamped in position by a rod inserted therethrough, said sample of said plastic spiral coil forming a rest for the concave binding edge of said book pages, said sample of said plastic spiral coil presenting a required convex shape of proper diameter matching a thickness of said book;

a page holding clamp for fixing in position said book pages after being positioned by said second length of spiral plastic coil; and, means for spinning said first spiral plastic coil and threading said coil through said spaced perforation along said binding edge.

* * * * *